US008517576B2

(12) United States Patent
Yang et al.

(10) Patent No.: US 8,517,576 B2
(45) Date of Patent: Aug. 27, 2013

(54) LIGHT EMITTING DIODE LAMP

(75) Inventors: Sung-Hsiang Yang, Miao-Li (TW); Yao-Chun Huang, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 96 days.

(21) Appl. No.: 13/300,631

(22) Filed: Nov. 20, 2011

(65) Prior Publication Data

US 2012/0087121 A1 Apr. 12, 2012

Related U.S. Application Data

(66) Substitute for application No. 12/898,718, filed on Oct. 6, 2010, now abandoned.

(51) Int. Cl.
*F21V 29/00* (2006.01)

(52) U.S. Cl.
USPC ..... 362/373; 362/294; 362/235; 313/46

(58) Field of Classification Search
USPC ..... 362/235, 277–284, 373, 294, 345, 362/311.01, 311.02, 311.14
See application file for complete search history.

(56) References Cited

U.S. PATENT DOCUMENTS 4,569,008 A * 2/1986 Creaser ..... 362/362

FOREIGN PATENT DOCUMENTS

FR 2886375 A1 * 12/2006
JP 2003186428 A * 7/2003

* cited by examiner

*Primary Examiner* — Mariceli Santiago
(74) *Attorney, Agent, or Firm* — Altis Law Group, Inc.

(57) ABSTRACT

An LED lamp comprises a lamp body and a colorized, translucent envelope detachably connected to the lamp body. The lamp body includes an LED module and the envelope covers the LED module. A color of the envelope is different from that of the light emitted by the LED module. The envelope changes the color of the light of the LED module when the light passes through the envelope to the outside.

11 Claims, 3 Drawing Sheets

LIGHT EMITTING DIODE LAMP

BACKGROUND

1. Technical Field

The present disclosure relates to lamps, and more particularly to a light emitting diode (LED) lamp.

2. Description of Related Art

The conventional LED lamp includes a number of LEDs and a transparent envelope covering the LEDs therein. The light emitted from the LEDs passes through the envelope to an outside for illumination. The light of the LED lamp has a color the same as that of the light of the LEDs. Since different LEDs with different materials emit lights with different colors, such as red LEDs, green LEDs, yellow LEDs and white LEDs, the color of the light of the LED lamp may be red, green, yellow or white, according to the LEDs. However, in the conventional LED lamp, the color of the light of the LED lamp is unchangeable after the LEDs are selected. Thus, the LED lamp fails to vary colors of the light and lacks a flexibility of meeting different requirements.

Therefore, an improved LED lamp is desired to overcome the described limitations.

DETAILED DESCRIPTION

Figure 1:
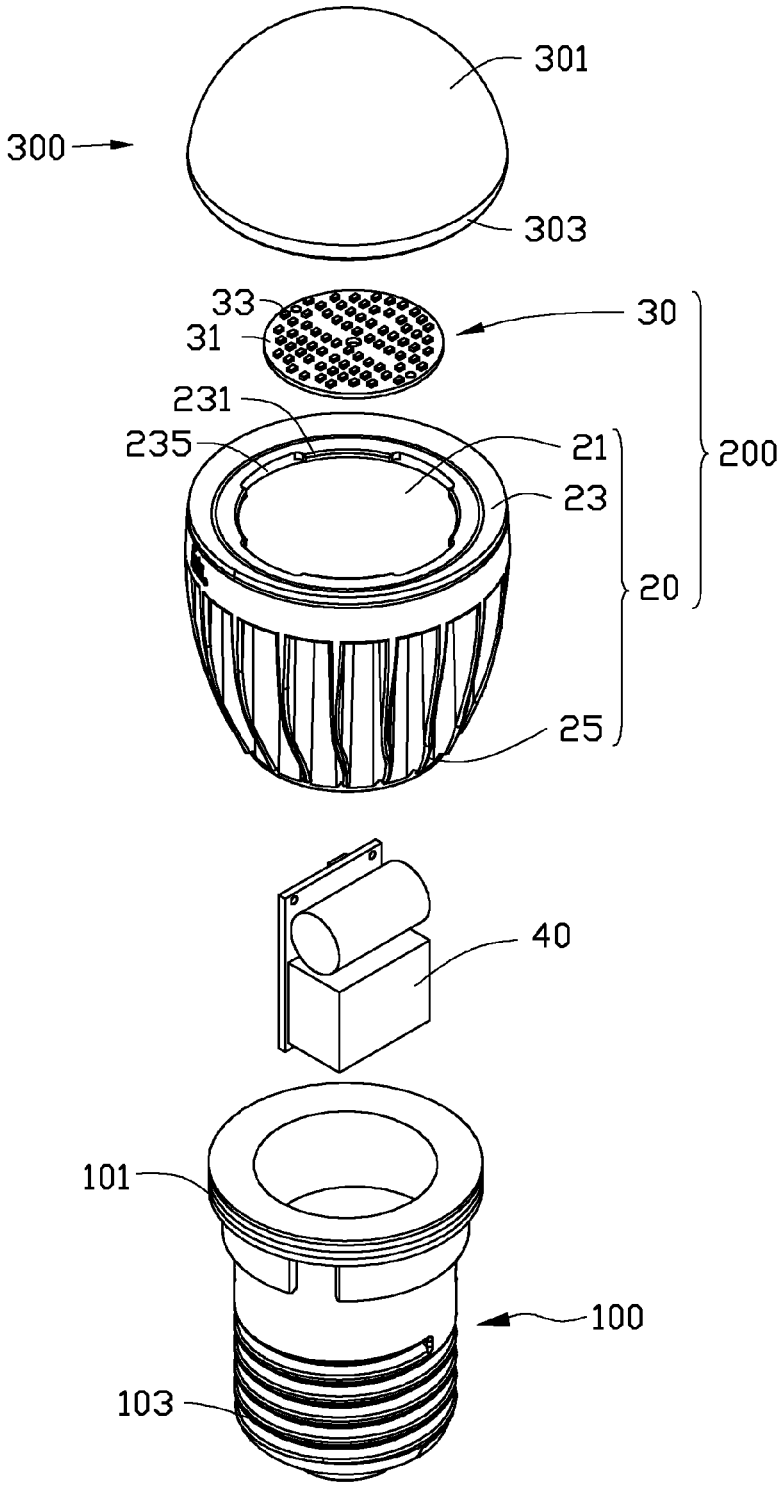
FIG. 1 is an exploded view of an LED lamp in accordance with an embodiment of the present disclosure.
Figure 2:
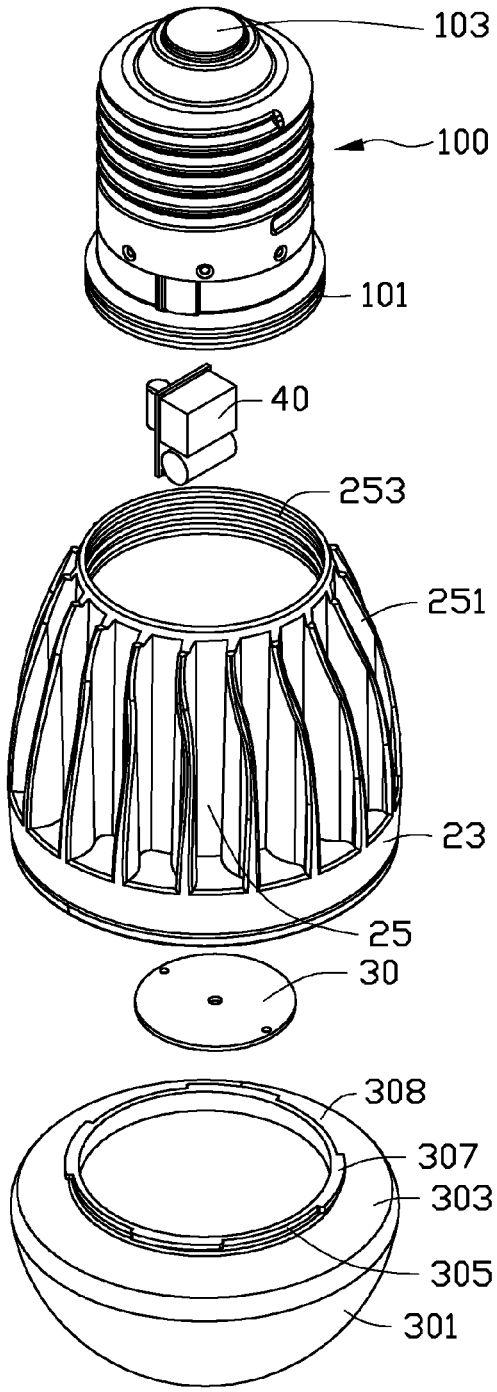
FIG. 2 is an inverted view of the LED lamp of FIG. 1.
Figure 3:
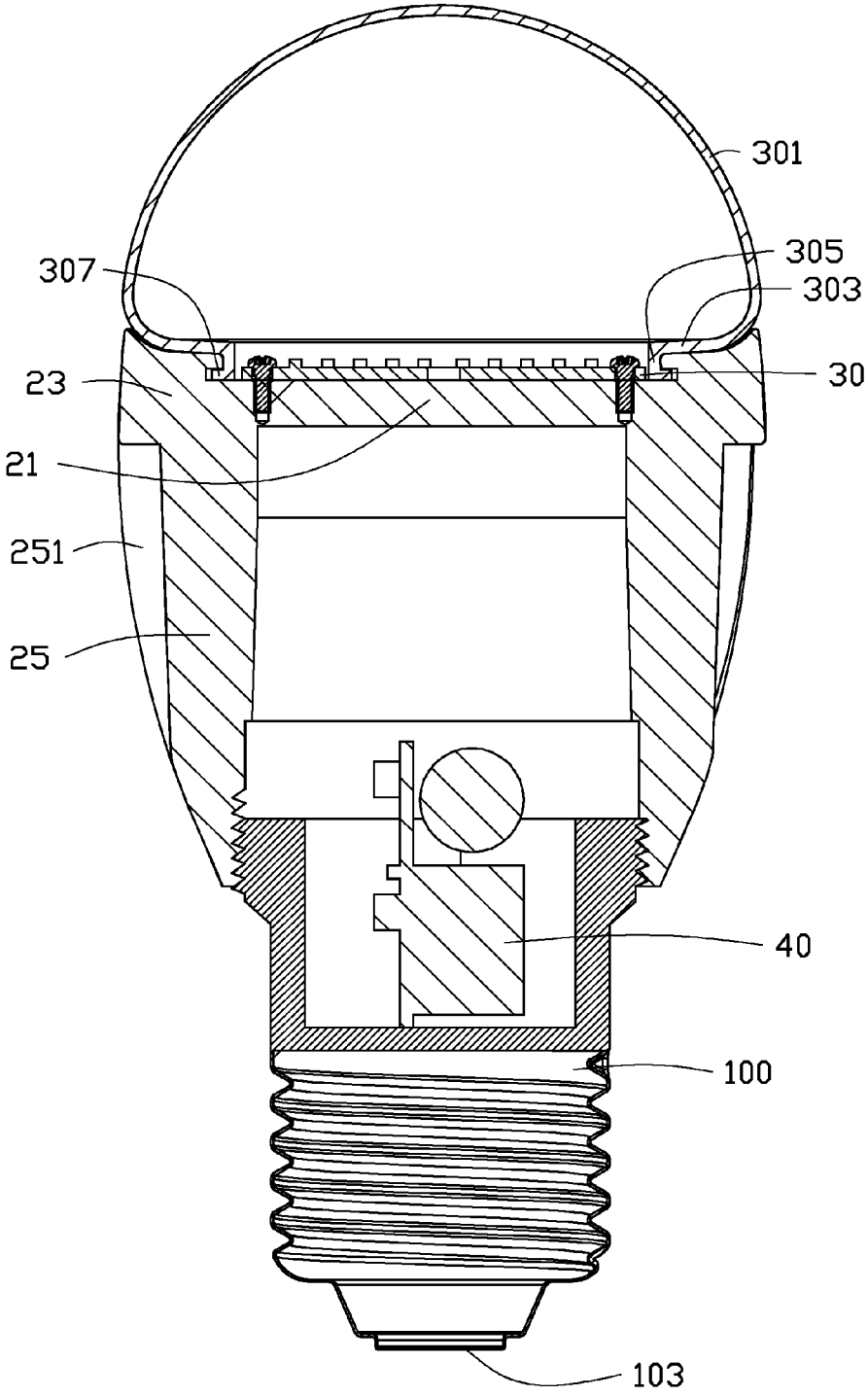
FIG. 3 is an assembled, cross-sectional view of the LED lamp of FIG. 1.

Referring to FIGS. 1-2, a light emitting diode (LED) lamp in accordance with an embodiment includes a lamp body 200, a driving circuit module 40 received in the lamp body 200, an electrical connector 100 connected to a bottom end of the lamp body 200, and an envelope 300 connected to a top end of the lamp body 200. The electrical connector 100 is for electrically connecting the driving circuit module 40 with an external power source (not shown) to provide power to the driving circuit module 40.

The lamp body 200 includes a supporting member 20 and an LED module 30 mounted on the supporting member 20. The supporting member 20 is made of aluminum, copper or an alloy thereof. The supporting member 20 includes a supporting plate 21, an engaging portion 23 extending upwardly from a circumference of the supporting plate 21, a heat dissipating portion 25 extending downwardly from the circumference of the supporting plate 21. The heat dissipating portion 25 is hollow and defines a cavity therein for receiving the driving circuit module 40. A size of the heat dissipating portion 25 gradually decreases downwardly from the supporting plate 21 towards the electrical connector 100. The heat dissipating portion 25 includes a plurality of spaced fins 251 for dissipating heat from the LED module 30. The fins 251 protrude radially and outwardly. A plurality of threads 253 is defined at an inner surface of a bottom of the heat dissipating portion 25 for threadedly engaging with the electrical connector 100. The driving circuit module 40 is received in the heat dissipating portion 25 and electrically connected with the LED module 30.

The supporting plate 21 of the supporting member 20 is substantially circular. The engaging portion 23 of the supporting member 20 is substantially annular. Four arced first engaging ribs 231 extend inwardly and horizontally from an inner periphery of the engaging portion 23. The first engaging ribs 231 each extend along a circumferential direction of the engaging portion 23. The first engaging ribs 231 are evenly arranged along the circumferential direction of the engaging portion 23 and spaced from each other with a first guide groove 235 defined between each two neighboring first engaging ribs 231. The first engaging ribs 231 are located at the same level and each are located above and spaced from the supporting plate 21 with a gap.

The LED module 30 includes a circuit board 31 and a plurality of white LEDs 33 mounted on the circuit board 31. The LED module 30 is mounted on the supporting plate 21 and located at a central portion of the supporting plate 21. The LEDs 33 emit white light during working.

The electrical connector 100 is connected with the bottom of the heat dissipating portion 25 of the supporting member 20 of the lamp body 200. A top section of the electrical connector 100 is cylindrical and hollow. A plurality of threads 101 is defined at an outer periphery of a top end of the electrical connector 100, to engage with the threads 253 of the inner surface of the heat dissipating portion 25 of the lamp body 200. The top end of the electrical connector 100 is threaded in the heat dissipating portion 25 of the lamp body 200, and the electrical connector 100 is electrically connected with the driving circuit module 40. An electrical contact 103 is formed at a bottom end of the electrical connector 100 to electrically connect with the external power source. The driving circuit module 40 receives the power from the external power source via the electrical connector 100. The electrical connector 100 can connect with a standard socket for conventional incandescent bulbs or compact fluorescent lamps, whereby the LED lamp in accordance with the present disclosure can replace the conventional incandescent bulbs or compact fluorescent lamps.

The envelope 300 is mounted on a top side of the supporting member 20 and covers the LED module 30. The envelope 300 is made of translucent material, for example, translucent glass or plastic. The envelope 300 includes a hollow, semi-spherical covering portion 301, a baffling portion 303 extending inwardly from a bottom edge of the covering portion 301, a connecting portion 305 extending downwardly and perpendicularly from an inner edge of the baffling portion 303, and four arced second engaging ribs 307 extending outwardly and perpendicularly from a bottom edge of the connecting portion 305. The second engaging ribs 307 each are located below and spaced from the baffling portion 303 with a gap.

Each second engaging rib 307 extends along a circumferential direction of the connecting portion 305. The second engaging ribs 307 are evenly spaced from each other with a second guide groove 308 defined between each two neighboring second engaging ribs 307. A length of each of the second engaging ribs 308 along the circumferential direction of the connecting portion 305 is not more than that of each of the first guide groove 235 of the supporting member 20. A length of each of the second guide grooves 308 along the circumferential direction of the connecting portion 305 is not less than that of each of the first engaging ribs 231 of the supporting member 20.

The covering portion 301 has an orange color. A diameter of the covering portion 301 is substantially equal to that of the engaging portion 23 of the supporting member 20. The baffling portion 303 is in the form of an annular plate. The connecting portion 305 is in the form of a hollow cylinder and perpendicular to the baffling portion 303. The gap between the baffling portion 303 and each of the second engaging ribs 307 has a depth substantially equal to a thickness of each of the first engaging ribs 231. A thickness of each of the second engaging ribs 307 is substantially equal to a depth of the gap between the supporting plate 21 and each of the first engaging ribs 231.

In assembly, the second engaging ribs 307 of the envelope 300 are respectively aligned with the first guide grooves 235 of the supporting member 20, and the first engaging ribs 231 of the supporting member 20 are respectively aligned with the second guide grooves 308 of the envelope 300. Then the envelope 300 is pushed towards the supporting member 20 to cause the second engaging ribs 307 to respectively extend through the first guide grooves 235 and abut against the supporting plate 21, and the first engaging ribs 231 respectively extend through the second guide grooves 308. At that time, the first engaging ribs 231 and the second engaging ribs 307 are staggered along the circumferential direction of the LED lamp. The envelope 300 is then rotated relative to the supporting member 20 to make the second engaging ribs 307 be sandwiched between the first engaging ribs 231 and the supporting plate 21 of the supporting member 20, and accordingly, the first engaging ribs 231 of the supporting member 20 are sandwiched between the second engaging ribs 307 and the baffling portion 303 of the envelope 300. Thus, the envelope 300 is detachably secured to the lamp body 200. When the LED lamp is disassembled, the envelope 300 is rotated with respect to the lamp body 200 to cause the first engaging ribs 231 of the supporting member 20 of the lamp body 200 to move to the second guide grooves 308 of the envelope 300, whereby the envelope 300 can be detached from the lamp body 200.

When the LED lamp works, the LEDs 33 emit white light outwardly and the light passing through the envelope 300. Since the color of the envelope 300 is orange, the envelope 300 changes the color of the light of the LEDs 33 when the light passes through the envelope 300. Thus, a color of the light of the LED lamp is changed to orange by the envelope 300. As the envelope 300 is detachably connected with the lamp body 200, and the envelope 300 is easy to be dissembled from the lamp body 200, the envelope 300 can thus be easily replaced by another envelope of different color from the orange of the envelope 300. Accordingly, the color of the light of the LED lamp is easy to change by replacing the envelope 300 to meet different requirements.

Alternatively, except for white LED, the LEDs 33 can be selected from other LEDs which may emit light with other color, such as red, yellow, blue or green, and correspondingly, the envelope can be selected to have a color different from the color of the light emitted by the LEDs to thereby change the color of the light of the LEDs when the light passes through the envelope.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a lamp body comprising an LED module; and a colorized, translucent envelope detachably connected to the lamp body and covering the LED module, light emitted by the LED module passing through the envelope to outside;

wherein a color of the envelope is different from that of the light of the LED module, and the envelope changes the color of the light of the LED module when the light passes through the envelope to the outside;

wherein the lamp body comprises a supporting plate and a plurality of first engaging ribs, each of the first engaging ribs is spaced from the supporting plate, the first engaging ribs are spaced from each other with a first guide groove defined between each two neighboring first engaging ribs, the envelope comprises a covering portion and a plurality of second engaging ribs, the second engaging ribs are spaced from each other with a second guide groove defined between each two neighboring second engaging ribs, the first engaging ribs are extended through the second guide grooves and the second engaging ribs are extended through the first guide grooves, and then the envelope is rotated relative to the lamp body to make the second engaging ribs be sandwiched between the first engaging ribs and the supporting plate, whereby the envelope is detachably connected to the lamp body and covers the LED module;

wherein the lamp body further comprises an engaging portion extending upwardly from a circumference of the supporting plate, and the first engaging ribs extend inwardly from the engaging portion; and wherein the lamp body further comprises a heat dissipating portion extending downwardly from the circumference of the supporting plate.

2. The LED lamp of claim 1, wherein the first engaging ribs are evenly arranged along a circumferential direction of the lamp body, and the second engaging ribs are evenly arranged along a circumferential direction of the envelope.

3. The LED lamp of claim 1, wherein a size of the heat dissipating portion gradually decreases downwardly from the supporting plate.

4. The LED lamp of claim 1, wherein the heat dissipating portion has a plurality of fins protruding radially and outwardly.

5. The LED lamp of claim 1, further comprising an electrical connector, the electrical connector forming a plurality of threads at an outer periphery of a top end thereof, the heat dissipating portion forming a plurality of threads at an inner surface of a bottom end thereof to threadedly engage with the threads of the electrical connector.

6. The LED lamp of claim 5, wherein an electrical contact is formed at a bottom end of the electrical connector.

7. The LED lamp of claim 1, wherein the envelope further comprises an annular baffling portion extending inwardly from a bottom edge of the covering portion, an annular connecting portion extending downwardly from the baffling portion, the second engaging ribs extending outwardly from the connecting portion.

8. The LED lamp of claim 7, wherein the covering portion of the envelope has a hollow, semispherical configuration.

9. The LED lamp of claim 1, wherein the LED module comprises a circuit board and a plurality of white LEDs.

10. The LED lamp of claim 9, wherein the color of the envelope is orange.

11. An LED lamp comprising:

a lamp body comprising an LED module; and a colorized, translucent envelope detachably connected to the lamp body and covering the LED module, light emitted by the LED module passing through the envelope to outside;

wherein a color of the envelope is different from that of the light of the LED module, and the envelope changes the color of the light of the LED module when the light passes through the envelope to the outside;

wherein the lamp body comprises a supporting plate and a plurality of first engaging ribs, each of the first engaging ribs is spaced from the supporting plate, the first engaging ribs are spaced from each other with a first guide groove defined between each two neighboring first engaging ribs, the envelope comprises a covering portion and a plurality of second engaging ribs, the second engaging ribs are spaced from each other with a second guide groove defined between each two neighboring second engaging ribs, the first engaging ribs are extended through the second guide grooves and the second engaging ribs are extended through the first guide grooves, and then the envelope is rotated relative to the lamp body to make the second engaging ribs be sandwiched between the first engaging ribs and the supporting plate, whereby the envelope is detachably connected to the lamp body and covers the LED module; and wherein the envelope further comprises an annular baffling portion extending inwardly from a bottom edge of the covering portion, an annular connecting portion extending downwardly from the baffling portion, the second engaging ribs extending outwardly from the connecting portion.

* * * * *